US009511963B2

(12) United States Patent
Ota et al.

(10) Patent No.: US 9,511,963 B2
(45) Date of Patent: Dec. 6, 2016

(54) CONVEYOR DEVICE

(71) Applicants: Yasuhira Ota, Yatomi (JP); Noriyuki Kawamata, Nagoya (JP); Masao Mimoto, Nagoya (JP); Keisuke Wakakusa, Nagoya (JP); Iwane Sano, Obu (JP); Jie Xiu, Nagoya (JP); Shingo Ito, Kasugai (JP)

(72) Inventors: Yasuhira Ota, Yatomi (JP); Noriyuki Kawamata, Nagoya (JP); Masao Mimoto, Nagoya (JP); Keisuke Wakakusa, Nagoya (JP); Iwane Sano, Obu (JP); Jie Xiu, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/182,139

(22) Filed: Feb. 17, 2014

(65) Prior Publication Data

US 2014/0231225 A1 Aug. 21, 2014

(30) Foreign Application Priority Data

Feb. 18, 2013 (JP) ..... 2013-028763

(51) Int. Cl.

| | |
|---|---|
| ***B65H 5/06*** | (2006.01) |
| ***B65G 13/06*** | (2006.01) |
| ***B65G 13/04*** | (2006.01) |
| ***B65G 39/00*** | (2006.01) |

(52) U.S. Cl.
CPC ..... *B65H 5/062* (2013.01); *B65H 2404/174* (2013.01); *B65H 2801/06* (2013.01)

(58) Field of Classification Search
None
See application file for complete search history.

(56) References Cited

U.S. PATENT DOCUMENTS 5,261,526 A * 11/1993 Rombouts ..... B65G 39/025 193/35 MD
5,384,586 A * 1/1995 Hirano ..... B41J 2/16523 346/134
5,400,711 A * 3/1995 Kemp ..... B28D 1/088 101/350.3

FOREIGN PATENT DOCUMENTS

JP 2002-257147 A 9/2002

* cited by examiner

*Primary Examiner* — Kavel Singh
(74) *Attorney, Agent, or Firm* — Banner & Witcoff, Ltd.

(57) ABSTRACT

A conveyor device is described in which a conveyor roller is used to convey a medium inside a printing device with the conveyor roller extending in a width direction of the printing device. The conveyor roller receives a force from a following roller configured to face the conveyor roller. The conveyor roller is supported by one or more bearings. The one or more bearings include a shaft supporting portion that extends in the width direction to support the conveyor roller against the force of the following roller.

16 Claims, 9 Drawing Sheets

CONVEYOR DEVICE

CROSS-REFERENCE TO RELATED APPLICATION

This application claims priority from Japanese Patent Application No. 2013-028763, filed on Feb. 18, 2013, which is incorporated herein by reference in its entirety.

FIELD OF DISCLOSURE

Aspects described herein relate to a conveyor device that conveys a sheet by a conveyor roller rotatably supported by bearings.

BACKGROUND

There has been known a conveyor device that is allowed to convey a sheet along a conveyance path. As an example of such a conveyor device, there is an image recording apparatus, such as a printer or a multifunction device. The conveyor device includes one or more roller pairs to convey a sheet while pinching the sheet. Each of the one or more roller pairs includes a conveyor roller that extends in a width direction and rotates by transmission of a drive force from a motor and a following roller that is disposed facing the conveyor roller while being urged toward the conveyor roller and rotates following the rotation of the conveyor roller. A middle portion of the conveyor roller in the width direction comes into contact with a sheet and end portions of the conveyor roller in the width direction are rotatably supported by bearings, respectively. The bearings are supported by a frame of the conveyor device.

As an example of the above-described conveyor device, there has been known an inkjet recording apparatus in which both end portions of a shaft of a conveyor roller in the width direction are supported by bearings, respectively, and the bearings are disposed on a frame constituting a portion of the inkjet recording apparatus.

SUMMARY

In the known conveyor device, both end portions of the conveyor roller in the width direction may be supported by the bearings, respectively, nevertheless, the middle portion of the conveyor roller in the width direction might not be supported by any member. Therefore, there may be a risk that the conveyor roller may be deformed due to the urging of the following roller.

In order to solve the above-described problem, it may be conceivable that a distance in the width direction between the bearings that may support the respective end portions of the conveyor roller may be shortened. Nevertheless, the distance between the bearings might not be permitted to be less than a dimension in the width direction of the sheet having a maximum size that may be allowed to be conveyed in the conveyor device.

Accordingly, aspects of the disclosure have been made in light of the above-described problem. That is, aspects of the disclosure provide for a conveyor device that may reduce deformation of a conveyor roller.

In at least one aspect, a conveyor device includes a conveyor roller extending in a width direction orthogonal to a conveyance direction, the conveyor roller configured to receive a force orthogonal to both the width direction and the conveyance direction; a bearing configured to rotatably support the conveyor roller, and the bearing including a first shaft-support portion configured to rotatably support the conveyor roller and disposed outside of a conveyance area of the conveyor roller in the width direction; and a second shaft-support portion extending from the first shaft-support portion at least to the conveyance area with respect to the width direction, and configured to rotatably support the conveyor roller and expose a portion of a surface of the conveyor roller to the conveyance area.

According to the above-described configuration, the second support portion disposed on at least one of the pair of bearings may extend to the sheet conveyance area. Thus, the distance between the bearings in the width direction may be shortened. Accordingly, the deformation of the conveyor roller caused by the urging of the following roller may be reduced. According to the above-described configuration, the second support portion may support the conveyor roller such that the portion, facing the following roller, of the conveyor roller may be exposed. Thus, the extension of the second support portion of at least one of the pair of bearings to the conveyance area might not interfere with the sheet conveyance and might not increase the size of the conveyor device in the width direction.

According to the aspects of the disclosure, the deformation of the conveyor roller may be reduced.

DESCRIPTION OF THE DRAWINGS

For a more complete understanding of the present disclosure, needs satisfied thereby, and the objects, features, and advantages thereof, reference now is made to the following descriptions taken in connection with the accompanying drawings.

DETAILED DESCRIPTION OF EMBODIMENTS

Figure 1:
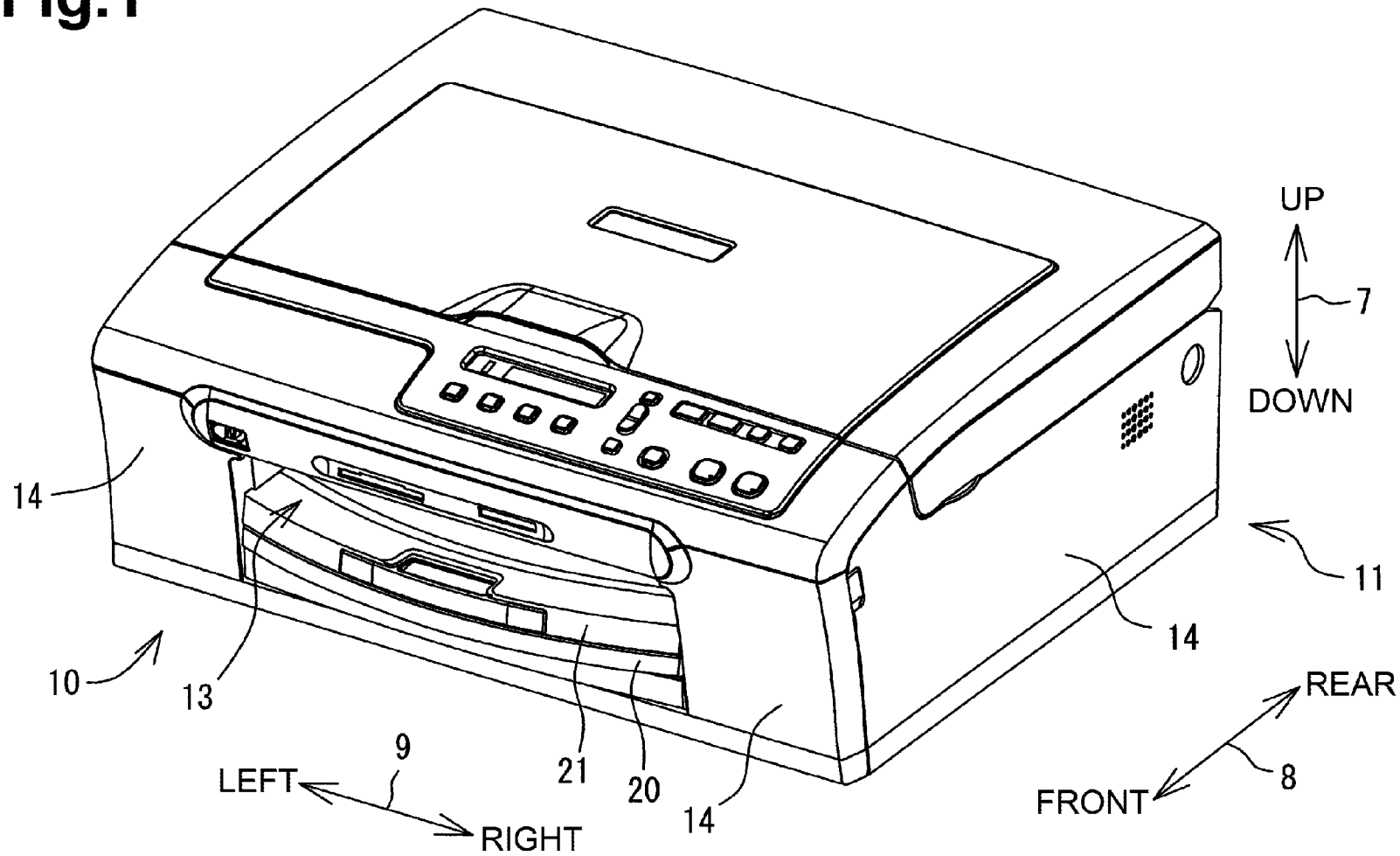
FIG. 1 is a perspective view depicting an illustrative example of a multifunction device in an illustrative embodiment according to one or more aspects of the disclosure.

An illustrative embodiment according to one or more aspects is described below with reference to the accompanying drawings. The illustrative embodiment described below is merely an example. Various changes, arrangements and modifications may be applied therein without departing from the spirit and scope of the disclosure. In the description below, an up-down direction 7 may be defined with reference to an orientation of a multifunction device 10 that may be disposed in which it may be intended to be used (e.g., an orientation depicted in FIG. 1). A side of the multifunction device 10, in which an opening 13 may be defined, may be defined as the front of the multifunction device 10. A front-rear direction 8 may be with reference to the front of the multifunction device 10. A right-left direction 9 may be defined with respect to the multifunction device 10 as viewed from its front.

Overall Configuration of Multifunction Device 10

As depicted in FIG. 1, the multifunction device 10 may have a substantially thin parallelepiped body and may comprise a printer unit 11 in its lower portion. The multifunction device 10 may have various functions, for example, a facsimile function and a printing function, enabled by known hardware, software, and computer control systems. The multifunction device 10 may have a function of recording an image onto one side of a recording sheet 12 (see FIG. 2) using an inkjet method, as the printing function. In other embodiments, for example, the multifunction device 10 may be configured to record an image on each side of a recording sheet 12. The printer unit 11 may comprise a conveyor device. The conveyor device may comprise a conveyor roller pair 59, a discharge roller pair 44, coil springs 73, a pair of bearings 80, a platen 42, coil springs 78, and a pair of side frames 55.

Feed Tray 20

Figure 2:
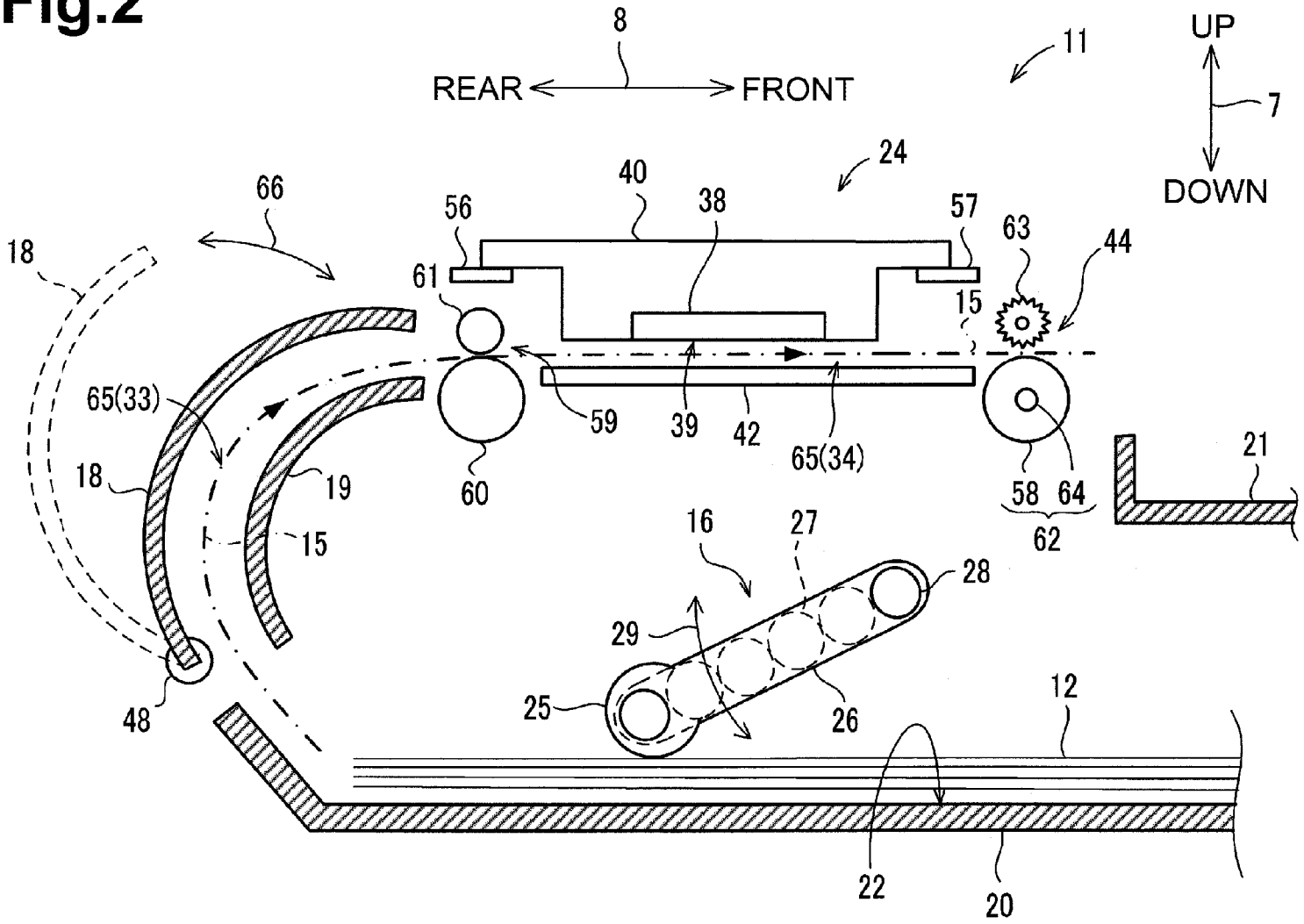
FIG. 2 is a schematic vertical sectional view depicting an internal configuration of a printer unit in the illustrative embodiment according to one or more aspects of the disclosure.

As depicted in FIG. 1, the printer unit 11 may have the opening 13 in its front. A feed tray 20 may be configured to be moved in the front-rear direction 8 to be inserted into or removed from the printer unit 11 via the opening 13. The feed tray 20 may be a box-shaped member with an open top. As depicted in FIG. 2, one or more recording sheets 12 may be stacked on a bottom plate 22 of the feed tray 20. An output tray 21 may be supported on an upper front of the feed tray 20. The output tray 21 may be configured to be moved in the front-rear direction 8 together with the feed tray 20. A recording sheet 12 on which an image has been recorded by a recording unit 24 may be outputted onto an upper surface of the output tray 21.

A pair of side guides (not depicted) that may be allowed to move in the right-left direction 9 may be supported by the bottom plate 22 of the feed tray 20. One side surface of each side guide may contact one of right and left edges of one or more recording sheets 12 placed on the bottom plate 22. As one of the side guides moves toward one side in the right-left direction 9, the other of the side guides may move toward the other side in the right-left direction 9 in synchronization with the movement of the one side guide. With this configuration, in the illustrative embodiment, one or more recording sheets 12 that may be placed in the feed tray 20 and may be to be conveyed in a conveyance path 65 and to be recorded with an image by a recording unit 24, may be aligned with a center line in the right-left direction 9.

Feed Unit 16

As depicted in FIG. 2, a feed unit 16 may be disposed above the feed tray 20 placed in the printer unit 11 and below the recording unit 24. The feed unit 16 may comprise a feed roller 25, a feed arm 26, and a power transmission mechanism 27. The feed roller 25 may be supported by a shaft at a distal end portion of the feed arm 26. The feed arm 26 may be configured to swing in directions indicated with an arrow 29 on a support shaft 28 disposed on a proximal end portion of the feed arm 26. With this configuration, the feed roller 25 may be allowed to come into contact with and come apart from the feed tray 20 or the one or more recording sheets 12 supported by the feed tray 20.

The feed roller 25 may be configured to rotate by transmission of a drive force from a conveyor motor 53 (see FIG. 3) by the power transmission mechanism 27 comprising a plurality of gears engaged with one another. Thus, an uppermost recording sheet 12 that may be in contact with the feed roller 25 in the one or more recording sheets 12 placed on the bottom plate 22 of the feed tray 20 may be fed into the conveyance path 65. In other embodiments, the feed roller 25 may be configured to rotate by application of a drive force from another motor provided independently from the conveyor motor 53. The power transmission mechanism 27 might not be limited to the above-described configuration in which the plurality of gears may be engaged with one another. In other embodiments, for example, the power transmission mechanism 27 may comprise a belt that may extend between the support shaft 28 and a shaft of the feed roller 25.

Conveyance Path 65

As depicted in FIG. 2, the conveyance path 65 may extend from a rear end of the feed tray 20. The conveyance path 65 may comprise a curved section 33 and a straight section 34. The curved section 33 may extend upward from the rear end of the feed tray 20 and be curved toward the front in the front-rear direction 8. The straight section 34 may extend along the front-rear direction 8.

The curved section 33 may be defined by an outside guide member 18 and an inside guide member 19 that may face each other and may be spaced apart from each other at a predetermined interval. The outside guide member 18 may define the outside portion of the curved section 33. The inside guide member 19 may define the inside portion of the curved section 33. The straight section 34 may be defined by the recording unit 24 and the platen 42 at a position where the recording unit 24 may be disposed, wherein the recording unit 24 and the platen 42 may face each other and be spaced apart from each other at a predetermined interval. The outside and inside guide members 18 and 19 may extend in the right-left direction 9 that may be orthogonal to a direction that the surface of the drawing sheet of FIG. 2 extends. With this configuration, the outside and inside guide members 18 and 19 may define at least a portion of the conveyance path 65.

The one or more recording sheets 12 supported by the feed tray 20 may be conveyed one-by-one by the feed roller 25 such that the recording sheet 12 may move upward and make a U-turn in the curved section 33, and thus, the recording sheet 12 may reach the conveyor roller pair 59. The recording sheet 12 pinched by the conveyor roller pair 59 may be then conveyed in the straight section 34 toward the recording unit 24 along the front-rear direction 8. The recording sheet 12 reached under the recording unit 24 may be recorded with an image by the recording unit 24. The recording sheet 12 recorded with the image may be then further conveyed in the straight section 34 along the front-rear direction 8 and thus may be outputted onto the output tray 21. As described above, the recording sheet 12 may be conveyed along a conveyance direction 15 indicated by a dotted-and-dashed line with an arrow in FIG. 2.

The outside guide member 18 may be configured to be pivotable in directions indicated by an arrow 66 on a shaft 48 disposed at a lower portion of the outside guide member 18. The outside guide member 18 may define the outside portion of the curved section 33 in a first state where the outside guide member 18 may be located at a position indicated by a solid line in FIG. 2, and may expose the curved section 33 in a second state where the outside guide member 18 may be located at a position indicated by a dashed line in FIG. 2. A user of the multifunction device 10 may be allowed to remove a recording sheet 12 jammed in the curved section 33 by changing the outside guide member 18 from the first state to the second state.

In other embodiments, the state change of the outside guide member 18 may be implemented in another manner instead of the pivot. For example, the outside guide member 18 may be configured to be attachable to and detachable from the printer unit 11. In this case, the state of the outside guide member 18 may be changed between a first state where the outside guide member 18 may be attached on the printer unit 11 and define the outside portion of the curved section 33 and a second state where the outside guide member 18 may be removed from the printer unit 11 and expose the curved section 33.

Recording Unit 24

As depicted in FIG. 2, the recording unit 24 may disposed at an upper side of the straight section 34. The platen 42 may be disposed below the recording unit 24 and face the recording unit 24. The platen 42 may comprise a plurality of ribs that may be disposed spaced apart from each other in the right-left direction 9 and extend in the front-rear direction 8. The platen 42 may be a member configured to support, by upper ends of the ribs, a recording sheet 12 being conveyed in the straight section 34 of the conveyance path 65 by the conveyor roller pair 59. The recording unit 24 may comprise a carriage 40 and a recording head 38.

The carriage 40 may be supported by two guide rails 56 and 57 so as to be able to reciprocate in the front-rear direction 8, wherein the guide rails 56 and 57 may be disposed spaced apart from each other. The recording head 38 may be mounted on the carriage 40. Ink may be supplied to the recording head 38 from an ink cartridge (not depicted). The recording head 38 may have nozzles 39 in its lower surface. While the carriage 40 moves in the right-left direction 9, the recording head 38 may eject ink droplets toward the platen 42 from the nozzles 39. Thus, an image may be recorded on the recording sheet 12 that may be supported by the platen 42 while being conveyed in the conveyance direction 15.

Conveyor Roller Pair 59 and Discharge Roller Pair 44

As depicted in FIG. 2, the conveyor roller pair 59 (as an example of a roller pair) may be disposed upstream of the recording head 38 of the recording unit 24 in the straight section 34 of the conveyance path 65 with respect to the conveyance direction 15. The discharge roller pair 44 may be disposed downstream of the recording head 38 of the recording unit 24 in the straight section 34 with respect to the conveyance direction 15.

Figure 3:
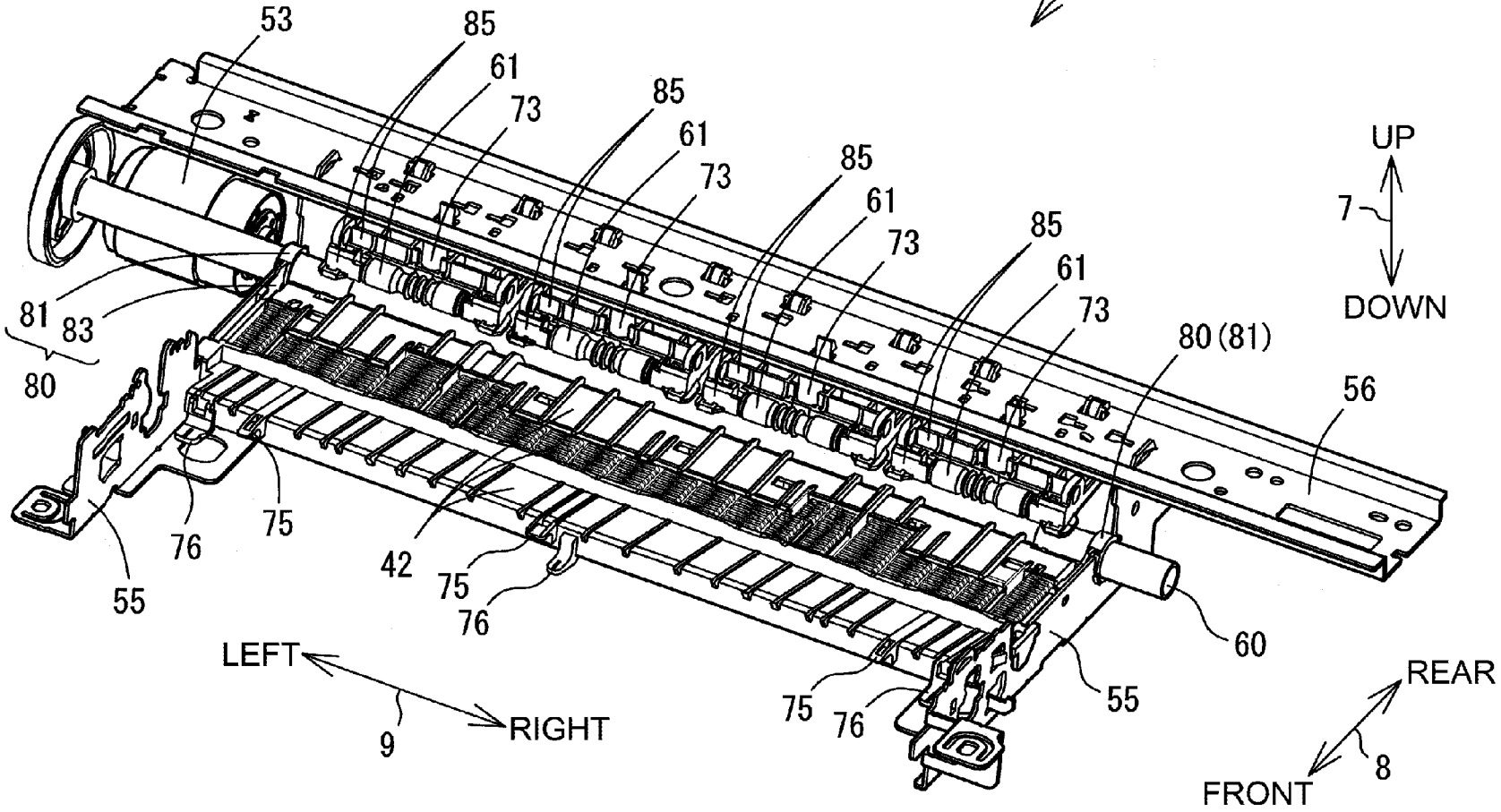
FIG. 3 is a perspective view depicting an area surrounding a pair of side frames and a guide rail in the printer unit in the illustrative embodiment according to one or more aspects of the disclosure.
Figure 4:
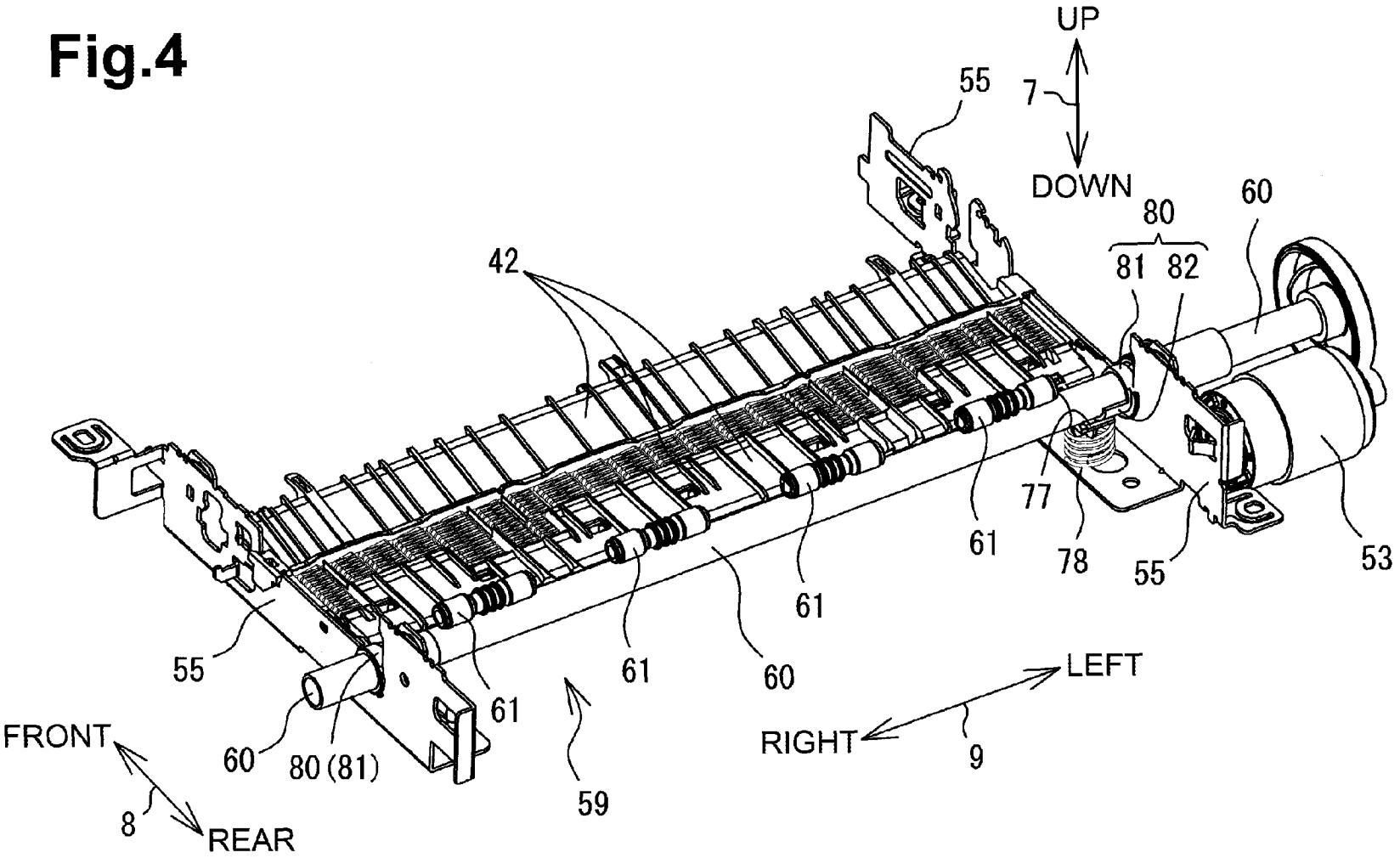
FIG. 4 is a perspective view depicting the side frames, a platen, a conveyor roller pair, and bearings in the illustrative embodiment according to one or more aspects of the disclosure.

The conveyor roller pair 59 may comprise a conveyor roller 60 disposed at the lower side of the straight section 34 and a pinch roller 61 (as an example of a following roller) disposed at the upper side of the straight section 34 with facing the conveyor roller 60. As depicted in FIGS. 3 and 4, the conveyor roller 60 may be a cylindrical member extending in the right-left direction 9 (as an example of a width direction), that is, a hollow cylindrical member.

As depicted in FIGS. 3 and 4, a plurality of pinch rollers 61 may be disposed spaced apart from each other in the right-left direction 9. The pinch rollers 61 may be rotatably supported by respective roller holders 85 provided corresponding to the respective pinch rollers 61. The roller holders 85 may be supported by the guide rail 56. The coil springs 73 (as an example of a first urging member) may be disposed between the guide rail 56 and the roller holders 85 in the up-down direction 7. One end of each coil spring 73 may be secured to the guide rail 56 and the other end of each coil spring 73 may be secured to an appropriate one of the roller holders 85. With this configuration, the pinch rollers 61 may be urged against the conveyor roller 60 by the coil springs 73.

As depicted in FIG. 2, the discharge roller pair 44 may comprise a discharge roller 62 disposed at the lower side of the straight section 34 and spurs 63 disposed at the upper side of the straight section 34 and face the discharge roller 62. The discharge roller 62 may comprise a shaft 64 that may extend in the right-left direction 9 and roller portions 58 that may be spaced apart from each other in the right-left direction 9 and cover the shaft 64 (see FIG. 8). The spurs 63 may be spaced apart from each other in the right-left direction 9. The spurs 63 may be disposed at respective positions facing the corresponding roller portions 58 of the discharge roller 62. The spurs 63 may be urged against the respective roller portions 58 of the discharge roller 62 by elastic members.

The conveyor roller 60 and the discharge roller 62 may be configured to rotate by the transmission of a drive force from the conveyor motor 53 (see FIG. 3). As the conveyor roller 60 rotates while the conveyor roller pair 59 may pinch a recording sheet 12 therebetween, the conveyor roller pair 59 may convey the recording sheet 12 to the platen 42, that is, in the conveyance direction 15. As the discharge roller 62 rotates while the discharge roller pair 44 may pinch the recording sheet 12, the discharge roller pair 44 may convey the recording sheet 12 in the conveyance direction 15.

Side Frames 55

As depicted in FIG. 3, the printer unit 11 may comprise a pair of side frames 55 (as an example of a support member) that may be spaced apart from each other in the right-left direction 9. One of the side frames 55 may be disposed at a further left position and the other of the side frames 55 may be disposed at a further right position than the straight section 34 of the conveyance path 65 in the right-left direction 9. The side frames 55 may be secured to and supported by a base frame (not depicted) by which their lower portions may be fastened to the base frame by screws or other known fastening techniques. The base frame may define the lower portion of the printer unit 11. The printer unit 11 may be defined by the base frame covered with exterior covers 14 (see FIG. 1).

Figure 5:
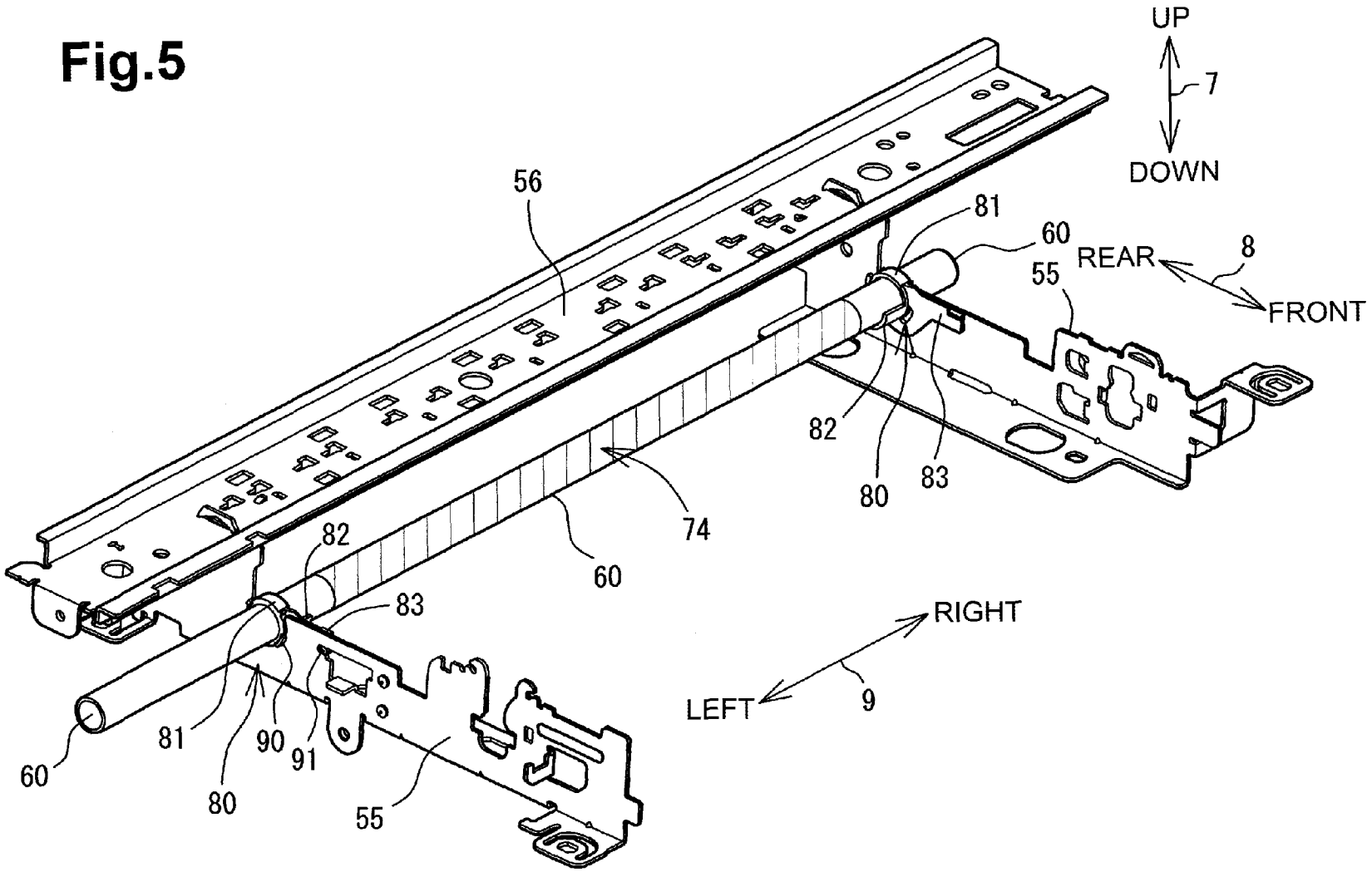
FIG. 5 is a perspective view depicting the side frames, the guide rail, a conveyor roller, and the bearings in the illustrative embodiment according to one or more aspects of the disclosure.
Figure 6:
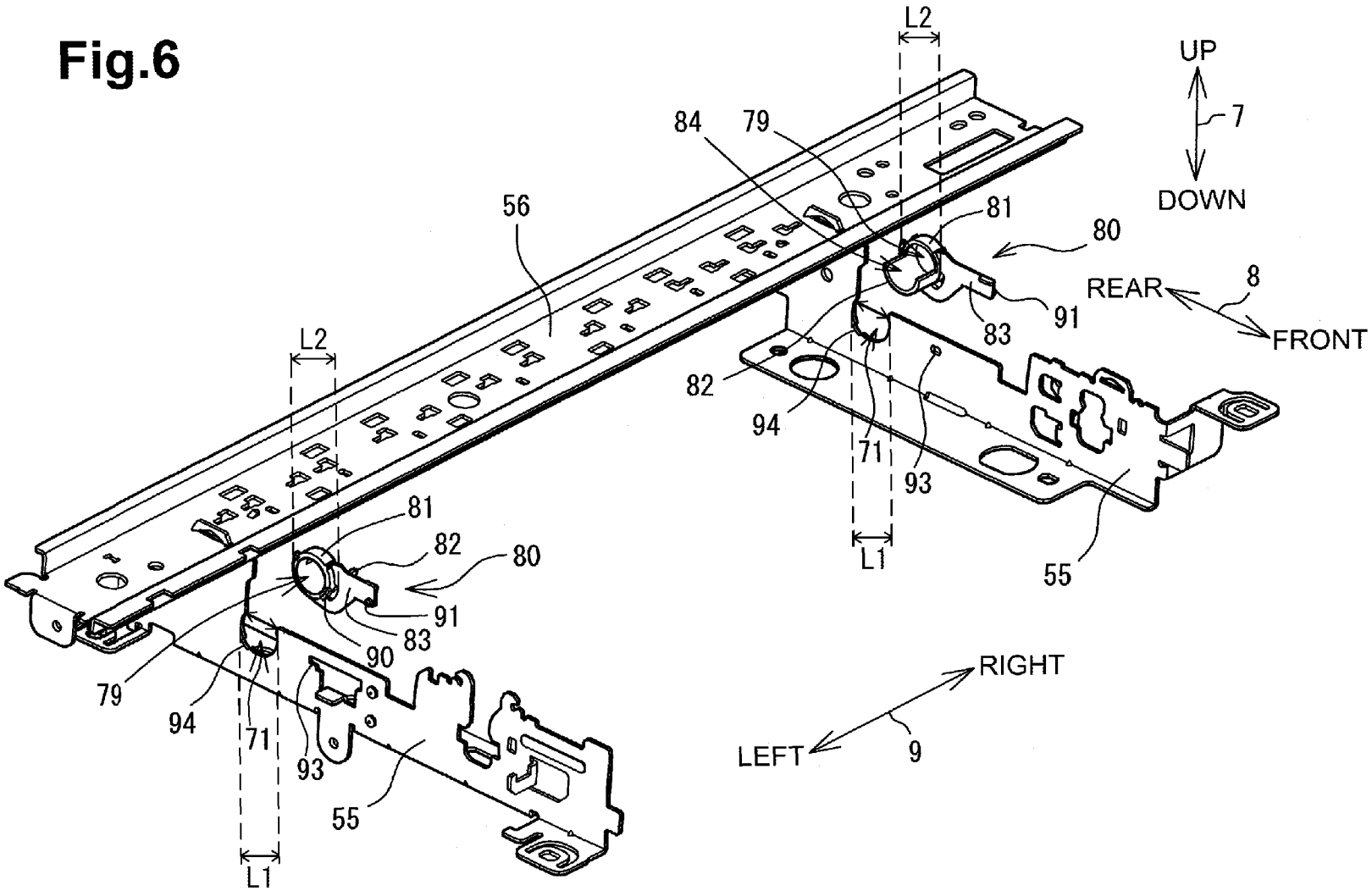
FIG. 6 is a perspective view depicting the side frames, the guide rail, and the bearings, wherein the bearings are removed from the respective side frames in the illustrative embodiment according to one or more aspects of the disclosure.

As depicted in FIG. 6, each of side frames 55 may have an engagement portion 71 that may be defined by which a portion of each of the side frames 55 may be cut out downward from its upper edge to have an arc shape. Bearings 80 may be fitted to the engagement portions 71, respectively. The bearings 80 may support the conveyor roller 60 (see FIG. 5). That is, the side frames 55 may support the conveyor roller 60 via the bearings 80 at the respective positions that may be the more left position and the more right position than the straight section 34 of the conveyance path 65. In the illustrative embodiment, a length L1 in the engagement portion 71 may be shorter than a length L2 of a portion, which may be fitted to the engagement portion 71, of the bearing 80 in the front-rear direction 8. Therefore, the bearings 80 may be fitted into the respective engagement portions 71 from the respective sides of the engagement portions 71 in the right-left direction 9.

Bearing 80

As depicted in FIGS. 4 and 5, the bearings 80 may support the conveyor roller 60. In the illustrative embodiment, as depicted in FIG. 6, each bearing 80 may have a circular opening 79. A diameter of the opening 79 may be substantially the same as a diameter of the conveyor roller 60. The conveyor roller 60 may pass through the openings 79. The conveyor roller 60 may be configured to be rotatable while being supported by the bearings 80. That is, the bearings 80 may support the conveyor roller 60 to be rotatable. The bearings 80 may be provided in a pair in correspondence with the side frames 55, respectively.

As depicted in FIG. 6, in the illustrative embodiment, each of the bearings 80 may comprise a first shaft-support portion 81, a second shaft-support portion 82, and a flange 83. The first shaft-support portion 81, the second shaft-support portion 82, and the flange 83 may be monolithic with each other or formed as separate parts then combined.

The first shaft-support portion 81 may have a circular tubular shape. The opening 79 may be defined in the first shaft-support portion 81. The conveyor roller 60 may pass through the opening 79. At least a portion of an internal circumferential surface of the opening 79 may be in contact with a surface of the conveyor roller 60 while the conveyor roller 60 may pass through the opening 79.

A recording sheet 12 being conveyed in the conveyance path 65 may come into contact with a portion of the surface of the conveyor roller 60 (more specifically, a portion that may extend in the right-left direction 9 and around an entire circumferential area of the surface of the conveyor roller 60). An area, with which the recording sheet 12 being conveyed in the conveyance path 65 may come into contact, of the surface of the conveyor roller 60 (as an example of a conveyance area) may be located between a more left position than the first shaft-support portion 81 that may be disposed at the more right position than the conveyance path 65 in the right-left direction 9 and a more right position than the first shaft-support portion 81 that may be disposed at the more left position than the conveyance path 65 in the right-left direction 9.

That is, the first shaft-support portion 81 may be disposed outside of the area, with which a recording sheet 12 may be come into contact, of the conveyor roller 60 in the right-left direction 9. More specifically, the first shaft-support portion 81 of the right bearing 80 (e.g., one of the pair of bearings 80) of the pair of bearings 80 may be disposed at a more right position than the area, which may come into contact with a recording sheet 12, of the conveyor roller 60 (e.g., further outside than the area on one side in the right-left direction 9). The first shaft-support portion 81 of the left bearing 80 (e.g., the other of the pair of bearings 80) of the pair of bearings 80 may be disposed at a further left position than the area, which may come into contact with a recording sheet 12, of the conveyor roller 60 (e.g., further outside than the area on the other side in the right-left direction 9).

The second shaft-support portion 82 may extend inward from the first shaft-support portion 81 in the right-left direction 9. More specifically, the second shaft-support portion 82 of the right bearing 80 of the pair of bearings 80 may extend leftward from the first shaft-support portion 81, and the second shaft-support portion 82 of the left bearing 80 of the pair of bearings 80 may extend rightward from the first shaft-support portion 81. The second shaft-support portion 82 may extend, in the right-left direction 9, from the first shaft-support portion 81 to the area, which may come into contact a recording sheet 12 being conveyed in the conveyance path 65, of the surface of the conveyor roller 60, and may contact the surface of the sheet contact area of the conveyor roller 60.

In the illustrative embodiment, the pinch rollers 61 may be disposed more inside than the second shaft-support portions 82 in the right-left direction 9. More specifically, the pinch rollers 61 may be disposed at respective positions that may be more left than the second shaft-support portion 82 of the right bearing 80 of the pair of bearings 80 in the right-left direction 9 and more right than the second shaft-support portion 82 of the left bearing 80 of the pair of bearings 80 in the right-left direction 9.

The second shaft-support portion 82 may be an arc-shaped thin plate. An arc-shaped inner surface 84 of the second shaft-support portion 82 may be contiguous to the internal circumferential surface of the opening 79 of the first shaft-support portion 81. The inner surface 84 may be in contact with the surface of the conveyor roller 60. The conveyor roller 60 may be rotarable in contact with the inner surface 84. That is, the second shaft-support portion 82 may support the conveyor roller 60 to be rotatable.

As depicted in FIG. 5, the conveyor roller 60 may comprise a surface that may come into contact with the second shaft-support portion 82. The conveyor roller 60 may be covered by the second shaft-support portion 82 in a portion that may be in contact with the second shaft-support portion 82, and the conveyor roller 60 may be exposed in the other portion that might not be in contact with the second shaft-support portion 82.

Figure 9A:
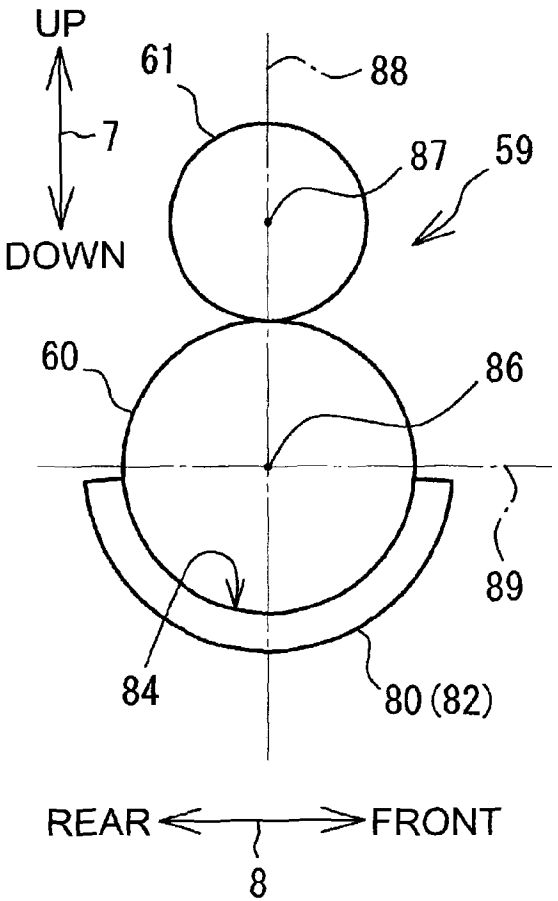
FIG. 9A is a schematic vertical sectional views depicting the conveyor roller pair in the illustrative embodiment according to one or more aspects of the disclosure.

As depicted in FIG. 9A, the second shaft-support portion 82 may support one area of the surface of the conveyor roller 60, wherein the one area may be located on an opposite side to a side where the pinch roller 61 may be present, with respect to a line 89 that may extend orthogonal to a line 88 passing a center 86 of the conveyor roller 60 and a center 87 of the pinch roller 61 in side view. That is, the second shaft-support portion 82 may support the conveyor roller 60 such that the other area of the surface of the conveyor roller 60 may be exposed, wherein the other area may be located on the side where the pinch roller 61 may be present with respect to the line 89.

Installation of Bearings 80 to Side Frames 55

As depicted in FIGS. 5 and 6, each bearing 80 comprising the first shaft-support portion 81 and the second shaft-support portion 82 may further comprise the flange 83, a first projection 90, and a second projection 91.

The first projection 90 may project from a portion of an external circumferential surface of the first shaft-support portion 81. The first projection 90 may extend along a circumferential direction of the external circumferential surface of the first shaft-support portion 81 to have a predetermined width. The predetermined width may be narrower than a width of a recess 94 defined in the engagement portion 71 of each of the side frames 55.

The flange 83 may be disposed more inside than the first projection 90 in the right-left direction 9 on the external circumferential surface of the first shaft-support portion 81. That is, the flange 83 may be disposed at a more left position than the first projection 90 and spaced apart from the first projection 90 at a predetermined interval in the right bearing 80 of the pair of bearings 80, and the flange 83 may be disposed at a more right position than the first projection 90 and spaced apart from the first projection 90 at the predetermined interval in the left bearing 80 of the pair of bearings 80. The predetermined interval may be substantially the same as a thickness of an end portion of the engagement portion 71 defined in each side frame 55 (i.e., a dimension in the right-left direction 9).

With this configuration, the end portion of the engagement portion 71 of the side frame 55 may be inserted between the first projection 90 of the bearing 80 and the flange 83 and thus the bearing 80 may be fitted in the engagement portion 71 of the side frame 55. That is, the flange 83 and the first projection 90 may define a groove therebetween such that the bearing 80 may be engaged in the engagement portion 71 of the side frame 55. In the state where the bearing 80 is disposed on the engagement portion 71, the first projection 90 and the second shaft-support portion 82 may be located on opposite sides of the side frame 55 and the flange 83 may be located on the second shaft-support portion 82 side with respect to the side frame 55 (see FIG. 5). The flange 83 may extend forward from the first shaft-support portion 81. In the illustrative embodiment, the flange 83 may have a thin plate shape that may extend in the up-down direction 7 and in the front-rear direction 8.

The second projection 91 may be disposed on the flange 83. The second projection 91 may project outward from the flange 83 in the right-left direction 9. That is, the second projection 91 may project rightward from a right surface of the flange 83 in the right bearing 80 of the pair of bearings 80, and the second projection 91 may project leftward from a left surface of the flange 83 in the left bearing 80 of the pair of bearings 80.

Each of the side frames 55 may have an opening 93 and the recess 94. The first shaft-support portion 81 may be configured to be fitted in the engagement portion 71 and be rotatable with being fitted in the engagement portion 71. The opening 93 may be disposed such that the opening 93 may coincide with the second projection 91 in side view when the bearing 80 is rotated with being fitted in the engagement portion 71. The opening 93 may have substantially the same shape and substantially the same size as the second projection 91. Thus, the second projection 91 may pass through the opening 93 and thus may be engagable in the opening 93 while the second projection 91 may coincide with the opening 93 in side view.

The recess 94 may be defined in the internal circumferential surface of the arc-shaped engagement portion 71. The recess 94 may be recessed in a direction from a center of the opening 79 to the outside when the bearing 80 is fitted in the engagement portion 71. The recess 94 may be disposed at a position that the recess 94 may coincide with the first projection 90 in side view when the bearing 80 is rotated with being fitted in the engagement portion 71. A length of the recess 94 along the internal circumferential surface of the engagement portion 71 may be longer than a length of the first projection 90 along the external circumferential surface of the first projection 90 disposed on the external circumferential surface of the first shaft-support portion 81. A depth of the recess 94 may be greater than a height of the first projection 90. Thus, the first projection 90 may pass the recess 94 in the right-left direction 9 while the first projection 90 may coincide with the recess 94 in side view.

The first projection 90 and the second projection 91 of the bearing 80 and the opening 93 and the recess 94 of the side frame 55 may be disposed at the respective positions to satisfy a condition described below. That is, the positions of the first projection 90, the second projection 91, the opening 93, and the recess 94 may be determined such that the first projection 90 might not be allowed to pass the recess 94 when the second projection 91 is in engagement with the opening 93. In other words, the second projection 91 may be allowed to pass the opening 93 of the side frame 55 when the first projection 90 does not coincide with the recess 94 in side view.

Hereinafter, a procedure of how to fit the left bearing 80 of the pair of bearings 80 into the engagement portion 71 of the left side frame 55 of the pair of side frames 55 is described with reference to FIG. 6. A procedure of how to fit the right bearing 80 into the engagement portion 71 of the right side frame 55 may be the same as the procedure of how to fit the left bearing 80 into the engagement portion 71 of the left side frame 55. Accordingly, a description of the fitting procedure for the right bearing 80 is omitted.

The bearing 80 may be located on the right of the engagement portion 71 while the first projection 90 may coincide with the recess 94 in side view. Then, the bearing 80 may be moved leftward. Thus, the first projection 90 may pass the recess 94 and the first shaft-support portion 81 may be fit in the engagement portion 71. After that, the first shaft-support portion 81 may be rotated such that the second projection 91 may coincide with the opening 93 in side view. Although the second projection 91 may come into contact with the right side-surface of the side frame 55 to interfere with the rotation of the first shaft-support portion 81, the first shaft-support portion 81 may be continuously rotated with the flange 83 being warped.

When the second projection 91 and the opening 93 coincide with each other in side view, the second projection 91 and the opening 93 may be engaged with each other. Thereafter, the first shaft-support portion 81 may become impossible to rotate unless the flange 83 is warped to release the engagement of the second projection 91 and the opening 93. That is, the second projection 91 may pass through the opening 93 defined in the side frame 55 to restrict the rotation of the first shaft-support portion 81 fitted in the engagement portion 71. When the second projection 91 coincides with the opening 93 in side view, the first projection 90 might not coincide with the recess 94 in side view. Therefore, the movement of the bearing 80 in the right-left direction 9 may also be restricted. A removal of the bearing 80 from the side frame 55 may be reverse of the above-described procedure.

Ceramic Coating

As depicted in FIG. 5, a ceramic coating (as an example of a high friction portion) may be applied on a predetermined area 74 (e.g., a hatched area in FIG. 5) that may be a portion of the surface of the conveyor roller 60 in the right-left direction 9. The ceramic coating may be applied on an entire circumference surface of the predetermined area 74. Therefore, a relatively higher friction may be applied to a recording sheet 12 pinched by the conveyor roller pair 59. Thus, reliability of the conveyance of the recording sheet 12 by the conveyor roller pair 59 may be increased.

The predetermined area 74 may be defined more inside than the second shaft-support portions 82 of the pair of bearings 80 in the right-left direction 9. In other words, the second shaft-support portions 82 may be disposed further outside than the predetermined area 74 of the surface of the conveyor roller 60 in the right-left direction 9. More specifically, the second shaft-support portion 82 of the left bearing 80 of the pair of bearings 80 may be disposed at a more left position than the predetermined area 74 and the second shaft-support portion 82 of the right bearing 80 of the pair of bearings 80 may be disposed at a more right position than the predetermined area 74.

In other embodiments, the surface of the conveyor roller 60 may be configured to apply higher friction to the recording sheet 12 in a manner other than the ceramic coating. For example, the surface of the conveyor roller 60 may comprise another material, such as rubber, instead of ceramic.

Platen 42

Figure 8:
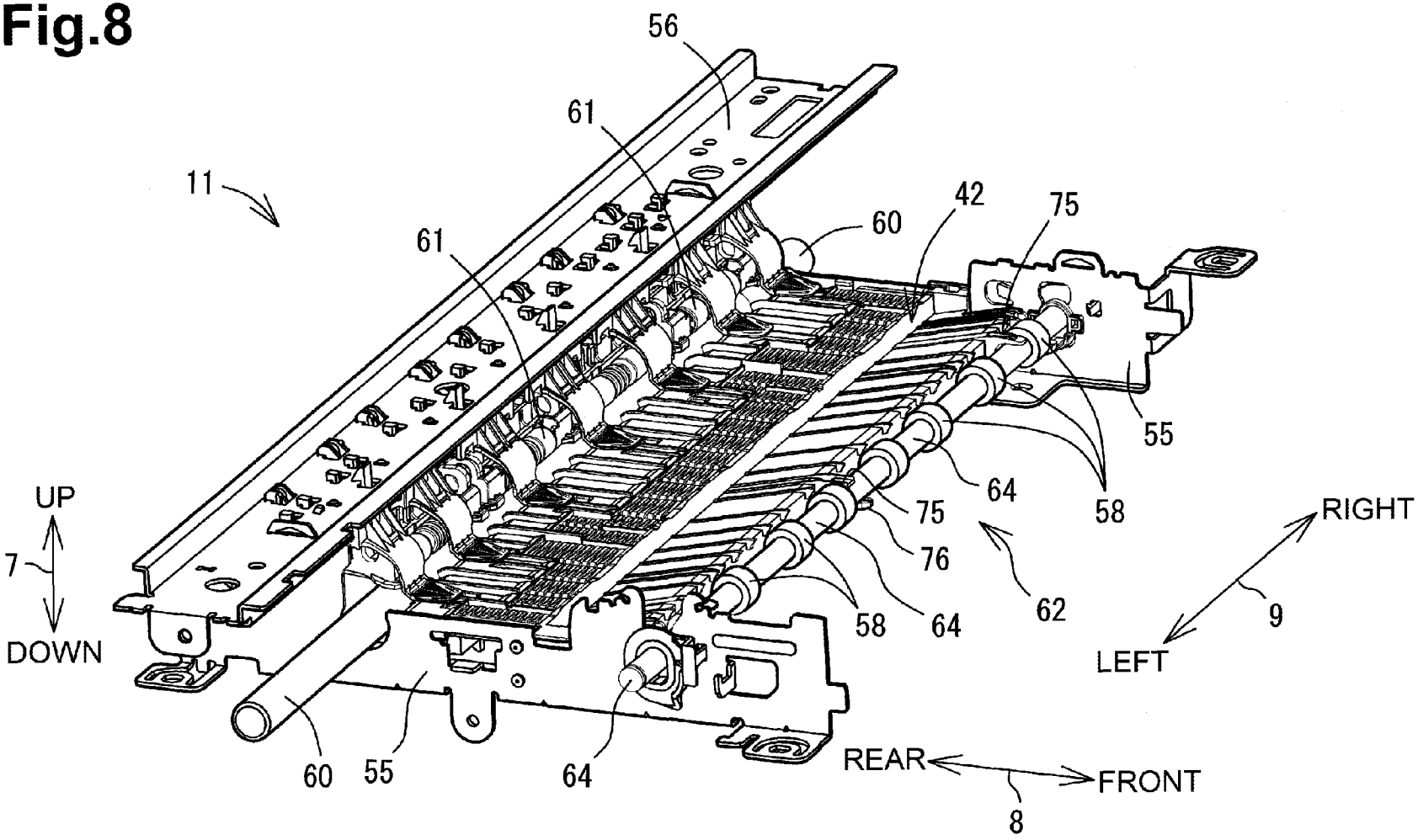
FIG. 8 is a perspective view depicting an area surrounding the pair of side frames and the guide rail in the printer unit in the illustrative embodiment according to one or more aspects of the disclosure.

As depicted in FIG. 2, the platen 42 may be disposed below the recording unit 24 with facing the recording unit 24. As depicted in FIG. 8, the platen 42 may comprise a first front protrusion 75 that may protrude forward from an upper front end of the platen 42 and a second front protrusion 76 that may protrude forward from a lower front end of the platen 42. The platen 42 may be disposed while the first front protrusion 75 and the second front protrusion 76 may sandwich the shaft 64 therebetween. With this configuration, the platen 42 may be configured to be pivotable on the shaft 64.

As depicted in FIG. 4, the platen 42 may further comprise rear protrusions 77 that may protrude rearward from both of right and left rear ends of the platen 42. Upper surfaces (as an example of a contact portion) of the rear protrusions 77 may be in contact with the second shaft-support portions 82 of the bearings 80, respectively, from below, that is, from a side opposite to the conveyor roller 60 with respect to the respective second shaft-support portions 82.

Upper ends of coil springs 78 (as an example of a second urging member) may be secured to the lower surfaces of the rear protrusions 77, respectively. The other ends of the coil springs 78 may be secured to the side frames 55, respectively. Nevertheless, in other embodiments, for example, the other ends of the coil springs 78 may be secured to another frame instead of the side frames 55. A length of each coil spring 78 in the state where the upper surfaces of the rear protrusions 77 may be in contact with the respective lower surfaces of the second shaft-support portions 82 may be shorter than its length in natural state. Thus, the coil springs 78 may urge the upper surfaces of the rear protrusions 77, respectively, upward, that is, toward the corresponding second shaft-support portions 82.

Effects of Illustrative Embodiment

According to the illustrative embodiment, the second shaft-support portions 82 of the pair of bearings 80 may extend to the conveyance area contacting the recording sheet 12. Thus, a distance between the bearings 80 in the right-left direction 9 may be shortened. As a consequence, the deformation of the conveyor roller 60 caused by the urging of the pinch rollers 61 may be restricted. According to the illustrative embodiment, the second shaft-support portions 82 may support the conveyor roller 60 such that the area, which may be located on the side where the pinch roller 61 may be present, of the surface of the conveyor roller 60 may be exposed. With this configuration, the presence of the second shaft-support portions 82 of the bearings 80 to the conveyance area might not interfere with the conveyance of the recording sheet 12 nor might not cause an increase in size of the multifunction device 10 in the right-left direction 9.

According to the illustrative embodiment, each of the bearings 80 may comprise the second shaft-support portion 82. Therefore, the distance between the bearings 80 in the right-left direction 9 may be further shortened as compared with a case where only one of the bearings 80 may have the second shaft-support portion 82.

According to the illustrative embodiment, the platen 42 may be pressed against the second shaft-support portions 82 by the coil springs 78. Thus, the platen 42 may be positioned with respect to the position of the conveyor roller 60. As described above, according to the illustrative embodiment, the deformation of the conveyor roller 60 may be restricted. Therefore, the platen 42 positioned with respect to the position of such a conveyor roller 60 may be positioned accurately.

According to the illustrative embodiment, the conveyor roller 60 may have the area on which the ceramic coating may be applied, on the portion of its surface. Thus, the nip force (at a nip point) between the conveyor roller 60 and the pinch rollers 61 may be increased. As a consequence, this configuration may allow the conveyor roller pair 59 to convey a recording sheet 12 easily. According to the illustrative embodiment, the second shaft-support portions 82 may be disposed further outside than the area, on which the ceramic coating may be applied, on the conveyor roller 60, in the right-left direction 9. Therefore, the portion coated with ceramic might not come into contact with the bearings 80. Thus, the bearings 80 may be avoided to be worn that may be caused by the frictional movement of the portion coated with ceramic on the bearings 80.

The hollow conveyor roller 60 may be likely to be deformed. Therefore, the configuration according to the illustrative embodiment may be preferable to implement the aspects of the disclosure.

As depicted in FIG. 9A, the area, which may be located on the opposite side to the side where the pinch roller 61 may be present, may be the supported area that may effectively restrict the deformation of the conveyor roller 60 caused by the urging of the pinch rollers 61. Therefore, according to the illustrative embodiment, the second shaft-support portions 82 may support such an area. Therefore, the restriction efficiency of the deformation of the conveyor roller 60 may be increased.

According to the illustrative embodiment, the first shaft-support portion 81 may be fitted in the engagement portion 71 by which the bearing 80 may be moved toward the engagement portion 71 of the side frame 55 in the right-left direction 9 after the first projection 90 coincides with the recess 94 in side view. Then, the first shaft-support portion 81 may be rotated while the first shaft-support portion 81 may be fitted in the engagement portion 71, whereby the first projection 90 might not coincide with the recess 94 in side view. Thus, the second projection 91 may be then allowed to pass through the opening 93. As a consequence, the rotation of the bearing 80 fitted in the engagement portion 71 may be prevented or reduced.

In the state where the second projection 91 passes through the opening 93, the first projection 90 might not coincide with the recess 94 in side view. Therefore, the movement of the bearing 80 in the right-left direction 9 might not be allowed because the end of the engagement portion 71 prevents the movement of the first projection 90. That is, according to the illustrative embodiment, this configuration may prevent or reduce the movement in the right-left direction 9 of the bearing 80 fitted in the engagement portion 71.

First Variation

In the above-described illustrative embodiment, both of the bearings 80 each may comprise the first shaft-support portion 81 and the second shaft-support portion 82. Nevertheless, in a first variation, for example, only one of the bearings 80 may comprise the first shaft-support portion 81 and the second shaft-support portion 82. In this case, the other of the bearings 80 may be, for example, a known ball bearing having a circular tubular shape. That is, in the aspects of the disclosure, at least one of the bearings 80 may comprise the first shaft-support portion 81 and the second shaft-support portion 82.

Second Variation

In the above-described illustrative embodiment, the multifunction device 10 may be configured to align one or more recording sheets 12 placed on the feed tray 20 with respect to the center line in the right-left direction 9. Nevertheless, in a second variation, for example, the multifunction device 10 may be configured to align one or more recording sheets 12 placed on the feed tray 20 with respect to a side plate (not depicted) uprightly disposed at one of the left and right ends of the bottom plate 22 of the feed tray 20 in the right-left direction 9. This side alignment may be implemented by, for example, a single side guide that may be disposed on the feed tray 20 and be movable in the right-left direction 9, instead of the pair of side guides.

In the second variation, when only the one of the bearings 80 comprises the first shaft-support portion 81 and the second shaft-support portion 82 in like manner as the first variation, the bearing 80 that may correspond to the side edge, which may be used as the reference of the sheet alignment, of the recording sheet 13 in the right-left direction 9 may preferably comprise the first shaft-support portion 81 and the second shaft-support portion 82.

Third Variation

Figure 7:
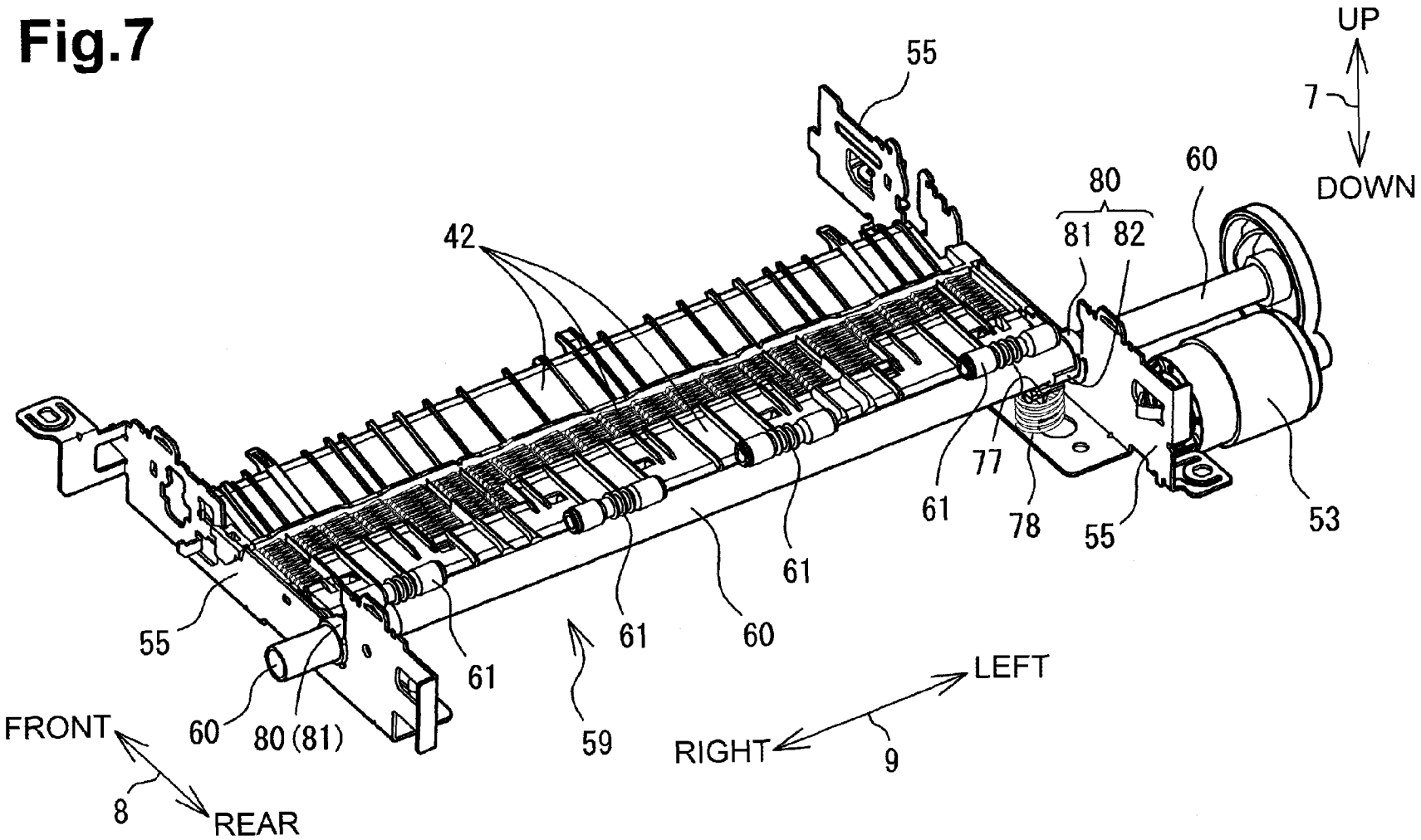
FIG. 7 is a perspective view depicting the side frames, the platen, the conveyor roller pair, and the bearings in a third variation of the illustrative embodiment according to one or more aspects of the disclosure.

In the above-described illustrative embodiment, the pinch rollers 61 may be disposed more inside than the second shaft-support portions 82 in the right-left direction 9. Nevertheless, in a third variation, for example, as depicted in FIG. 7, one or more of the pinch rollers 61 may be disposed to coincide with the second shaft-support portions 82, respectively, in the right-left direction 9, that is, at the same positions, respectively, as the second shaft-support portions 82 in the right-left direction 9, and may face the surface, which might not be supported by the second shaft-support portions 82, of the conveyor roller 60, that is, the exposed portion of the surface of the conveyor roller 60. With this configuration, the pinch rollers 61 may be allowed to pinch a recording sheet 12 between the pinch rollers 61 and the conveyor roller 60 at the same positions as the second shaft-support portions 82 in the right-left direction 9. Thus, the pinch rollers 61 may be allowed to contact and press the recording sheet 12 by the urging force from the coil springs 73. In this case, the pinch rollers 61 may be an example of a pressing member.

In the third variation described above, one or more of the pinch rollers 61 may be disposed at the same positions as the second shaft-support portions 82 in the right-left direction 9. Nevertheless, in other embodiments, for example, another member other than the pinch rollers 61 may press the recording sheet 12 at the same positions as the second shaft-support portions 82 in the right-left direction 9. That is, the pinch rollers 61 may be disposed more inside than the second shaft-support portions 82 in the right-left direction 9 in like manner with the above-described illustrative embodiment, and one or more pressing members each comprising a protrusion protruding downward may be disposed at the same positions as the second shaft-support portions 82 in the right-left direction 9 so as to face the respective second shaft-support portions 82. The pressing members may be configured to come into contact with the upper surface of the recording sheet 12.

According to the third variation, the pressing members such as the pinch rollers 61 may come into contact with the both side edge portions of the recording sheet 12 in the right-left direction 9, thereby restricting a lifting of the both side edge portions of the recording sheet 12 in the right-left direction 9. In a case where the pinch rollers 61 are adopted as the pressing members, another pressing member might not be needed in addition to the pinch rollers 61.

Fourth Variation

In the above-described illustrative embodiment, as depicted in FIG. 9A, the second shaft-support portions 82 may cover and support the one area of the conveyor roller 60, wherein the one area may be located on the opposite side to the side where pinch roller 61 with respect to the line 89. Nevertheless, in a fourth variation, the area where the second shaft-support portions 82 may support the conveyor roller 60 might not be limited to the one area depicted in FIG. 9A.

Figure 9B:
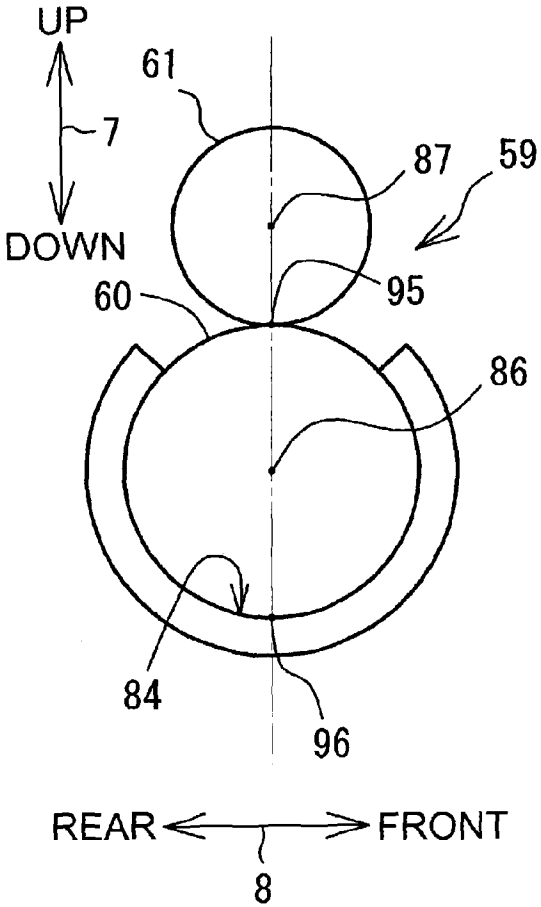
FIGS. 9B and 9C are schematic vertical sectional views each depicting the conveyor roller pair in a fourth variation of the illustrative embodiment according to one or more aspects of the disclosure.
Figure 9C:
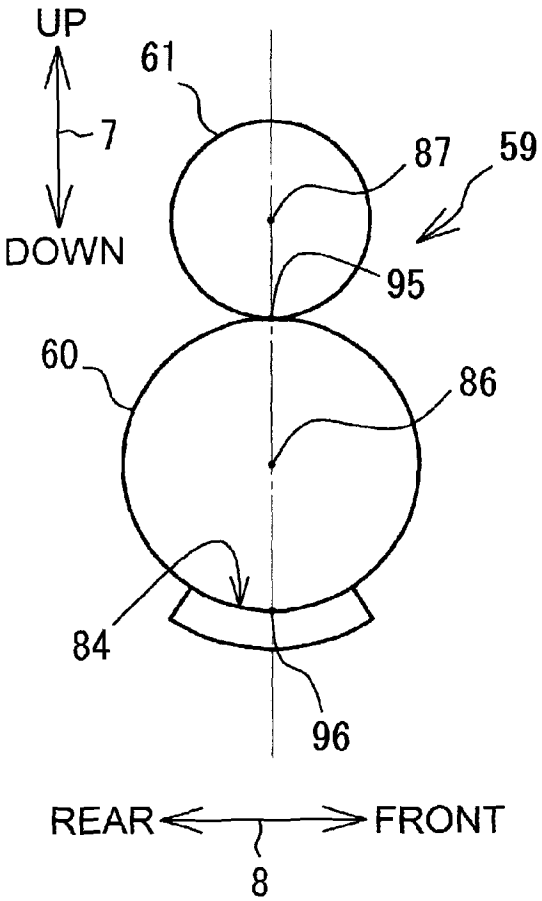

For example, as depicted in FIGS. 9B and 9C, the second shaft-support portions 82 may be configured to support a portion comprising a position 96 that may be opposite to a pinching position 95 of a recording sheet 12 by the conveyor roller pair 59 with respect to the center 86 of the conveyor roller 60.

According to the fourth variation, the position 96 that may be opposite to the pinching position 95 of the recording sheet 12 by the conveyor roller pair 59 with respect to the conveyor roller 60 may be a supported position where the deformation of the conveyor roller 60 caused by the urging of the pinch rollers 61 may be effectively restricted. Therefore, according to the fourth variation, the second shaft-support portion 82 may support the portion including the position 96 described above.

Therefore, the restriction efficiency of the deformation of the conveyor roller 60 may be increased.

Fifth Variation

In the above-described illustrative embodiment, the conveyor roller 60 may be the hollow cylindrical member. Nevertheless, the shape of the conveyor roller 60 might not be limited to the hollow cylindrical shape. In a fifth variation, for example, the conveyor roller 60 might not necessarily have a hollow structure. The conveyor roller 60 may comprise a shaft extending in the right-left direction 9 and a roller portion covering the shaft. In this case, the conveyor roller 60 may comprise a single roller portion extending in the right-left direction 9 or a plurality of roller portions spaced apart from each other in the right-left direction 9.

Sixth Variation

In the above-described illustrative embodiment, the first shaft-support portion 81 of each of the bearings 80 may have the opening 79. Nevertheless, in a sixth variation, for example, the first shaft-support portion 81 may be configured to contact a portion of the surface of the conveyor roller 60 to support the conveyor roller 60 similar to the second shaft-support portion 82.

Seventh Variation

In the above-described illustrative embodiment, the conveyor roller 60 may be disposed at the lower side of the straight section 34 and the pinch rollers 61 may be disposed at the upper side of the straight section 34 with facing the conveyor roller 60. Nevertheless, in a seventh variation, for example, the conveyor roller 60 may be disposed at the upper side of the straight section 34 and the pinch rollers 61 may be disposed at the lower side of the straight section 34 with facing the conveyor roller 60 with the second support portion or portions 82 opposite at least a part of straight section 34.

What is claimed is:

1. A conveyor device comprising:

a conveyor roller extending in a width direction orthogonal to a conveyance direction, wherein the conveyor roller rotates around a first axis;

a following roller disposed facing the conveyor roller;

a first urging member configured to urge the following roller toward the conveyor roller; and a bearing configured to rotatably support the conveyor roller, and the bearing including:

a first shaft-support portion configured to rotatably support the conveyor roller and disposed outside of a conveyance area of the conveyor roller in the width direction; and a second shaft-support portion affixed to the first shaft-support portion and extending in a direction parallel to the first axis from the first shaft-support portion toward the conveyance area, wherein the second shaft-support portion is configured to rotatably support the conveyor roller, cover a portion of a circumference of the conveyor roller, and expose another portion of the circumference of the conveyor roller with the exposed portion being on a same side as a side of the conveyor roller facing the following roller.

2. The conveyor device according to claim 1, further comprising a pair of bearings, each of the pair of bearings comprising the first shaft-support portion and the second shaft-support portion, wherein the first shaft-support portion of one bearing of the pair of bearings is disposed outside of the conveyance area of the conveyor roller on one side in the width direction, and wherein the first shaft-support portion of the other bearing of the pair of bearings is disposed outside of the conveyance area of the conveyor roller on another side in the width direction.

3. The conveyor device according to claim 1, further comprising:

a platen configured to support a sheet being conveyed by the conveyor roller and the following roller;

a contact portion disposed on the platen and configured to contact the second shaft-support portion from a side opposite to the conveyor roller; and a second urging member configured to urge the contact portion toward the second shaft-support portion.

4. The conveyor device according to claim 1, wherein the conveyor roller comprises a high friction portion at a portion of a surface thereof in the width direction, and wherein the second shaft-support portion is disposed outside of the high friction portion with respect to the width direction.

5. The conveyor device according to claim 1, further comprising a pressing member disposed at a position corresponding to the second shaft-support portion with respect to the width direction and facing the exposed portion of the surface of the conveyor roller supported by the second support portion, and the pressing member configured to contact a sheet being conveyed by the conveyor roller and the following roller.

6. The conveyor device according to claim 1, wherein the following roller is disposed at a position corresponding to the second shaft-support portion with respect to the width direction and facing the exposed portion of the surface of the conveyor roller supported by the second shaft-support portion.

7. The conveyor device according to claim 1, wherein the conveyor roller has a hollow structure.

8. The conveyor device according to claim 1, wherein the second shaft-support portion is configured to support at least a point that is opposite to a nip point of the conveyor roller and the following roller, on a surface of the conveyor roller, in side view.

9. The conveyor device according to claim 1, wherein the second shaft-support portion is configured to support one area of the surface of the conveyor roller, wherein the one area is located on an opposite side to a side where the following roller is present, with respect to a line that extends orthogonal to a line that passes a center of the conveyor roller and a center of the following roller, in side view.

10. The conveyor device according to claim 1, further comprising a support member configured to support the bearing, the support member comprising an engagement portion, wherein the bearing is configured to fit in the engagement portion.

11. The conveyor device according to claim 10, wherein the bearing further comprises a first projection, a flange, and a second projection, and wherein the first projection projects from an external circumferential surface of the first shaft-support portion, wherein the flange disposed on the external circumferential surface of the first shaft-support portion and spaced apart from the first projection with respect to the width direction, wherein the first shaft-support portion is configured to engage with the engagement portion such that the engagement portion is located between the first projection and the flange, wherein the second projection projects from the flange and is configured to pass through an opening defined in the support member to restrict the rotation of the first shaft-support portion fitted in the engagement portion, wherein the engagement portion has a recess that allows the first projection to pass therethrough with respect to the width direction, wherein the recess coincides with the first projection, in side view, in a state where the first shaft-support portion is fitted in the engagement portion, and wherein the second projection is configured to pass through the opening of the support member in a state where the first projection does not coincide with the recess in side view.

12. A conveyor device comprising:

a conveyor roller extending in a width direction orthogonal to a conveyance direction, the conveyor roller configured to receive a force orthogonal to both the width direction and the conveyance direction, wherein the conveyor roller rotates around a first axis;

a bearing configured to rotatably support the conveyor roller, and the bearing including:

a first shaft-support portion configured to rotatably support the conveyor roller and disposed outside of a conveyance area of the conveyor roller in the width direction; and a second shaft-support portion affixed to the first shaft-support portion and extending in a direction parallel to the first axis from the first shaft-support portion toward and at least to an edge of the conveyance area, wherein the second shaft-support portion is configured to rotatably support the conveyor roller, cover a portion of a circumference of the conveyor roller, and expose another portion of the surface of the conveyor roller to the conveyance area.

13. The conveyor device according to claim 12, further comprising:

a following roller disposed facing the conveyor roller, the following roller configured to receive an urging force that urges the following roller in the direction of the conveyor roller.

14. The conveyor device according to claim 13, further comprising:

a first urging member, the first urging member being configured to supply the urging force.

15. The conveyor device according to claim 13, wherein the portion of the surface of the conveyor roller is exposed to the following roller.

16. A conveyor device comprising:

a conveyor roller extending in a width direction orthogonal to a conveyance direction, the conveyor roller configured to receive a force in a direction orthogonal to both the width direction and the conveyance direction, the conveyor roller include a circumference;

a platen located downstream from the conveyor roller in the conveyance direction, the platen having a side extending in the conveyance direction;

a bearing configured to rotatably support the conveyor roller, and the bearing including:

a first shaft-support portion configured to rotatably support the conveyor roller; and a second shaft-support portion extending from the first shaft-support portion in the width direction such that the second portion extends in the width direction past the side of the platen, the second shaft-support portion encircling a portion but less than all of the circumference of the conveyor roller, and the second shaft-support portion being configured to rotatably support the conveyor roller opposite to the force direction.

* * * * *